US006179520B1

(12) United States Patent
Cochran

(10) Patent No.: US 6,179,520 B1
(45) **Date of Patent: *Jan. 30, 2001**

(54) EARTH COMPACTING MACHINE

(76) Inventor: Gary Cochran, 3052 N. Forrest Lakes, Wichita, KS (US) 67205

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/127,176

(22) Filed: Jul. 31, 1998

(51) Int. Cl.[7] ..... E01C 19/22; E01C 19/38

(52) U.S. Cl. ..... 404/114; 404/118; 172/245; 37/403

(58) Field of Search ..... 404/96, 102, 103, 404/104, 118, 114, 117, 127, 128, 133.05, 133.2; 172/245, 247, 253; 37/403, 407

(56) References Cited

U.S. PATENT DOCUMENTS 3,336,848 * 8/1967 Moir ..... 404/75
4,930,935 * 6/1990 Quenzi et al. ..... 404/75
5,248,216 * 9/1993 Vural ..... 404/117

FOREIGN PATENT DOCUMENTS

4109944 * 10/1992 (DE) ..... 404/117
2228759 * 12/1990 (GB) ..... 404/118
9401774 * 6/1996 (NL) .
0721495 * 3/1980 (RU) ..... 404/127

* cited by examiner

*Primary Examiner*—Eileen D. Lillis
*Assistant Examiner*—Raymond W Addie
(74) *Attorney, Agent, or Firm*—Kenneth H. Jack

(57) ABSTRACT

An earth compacting machine for attachment to the lift arms of a front loader tractor or skid steer loader, the lift arms having forward implement attachment ends, the lift arms having bucket rams providing pivotal motion of implements attached thereto, the earth compacting machine consisting of an earth compacting plate having an upwardly chamfered forward end, an attachment plate fixedly attached to and extending upwardly from the earth compacting plate, the attachment plate being adapted for attachment to the forward implement attachment ends of such lift arms of such front loader tractor or skid steer loader; and an imbalanced wheel vibrator fixedly attached to the upper surface of the earth compacting plate; the earth compacting plate further comprising a dirt grading blade section fixedly attached to the chamfered section of the earth compacting plate, the dirt grading blade section being positioned for dirt grading through actuation of the bucket rams.

1 Claim, 5 Drawing Sheets

EARTH COMPACTING MACHINE

RELATED U.S. PATENT APPLICATION

This patent application relates to a patent application entitled, Vibrating Mechanism, said patent application being filed by the applicant herein contemporaneously herewith with the U.S. Patent and Trademark Office.

FIELD OF THE INVENTION

This invention relates to earth compacting machines which are attachable as auxiliary hydraulically powered implements to heavy earth working equipment.

BACKGROUND OF THE INVENTION

Earth working implements which are attached to the lift arms of a common skid steer loader may be conveniently rotated about a lateral axis through extension or retraction of the skid steer's bucket rams. Similarly, such an implement may be conveniently rotated about a vertical axis through counter-rotation of the left and right wheels of the skid steer. Since the lift arms of a common skid steer loader move in unison, such an implement may not be conveniently rotated about a longitudinal axis. Similarly, implements attached to the boom arm of a common excavator or tractor backhoe may be rotated about a vertical axis through actuation of boom side swing rams; and such implements may be rotated about a lateral axis through actuation of the bucket ram of the boom arm. As with implements attached to the lift arms of a loader tractor or skid steer loader, implements attached to the boom arm of an excavator or backhoe tractors may not be conveniently rotated about a longitudinal axis.

Thus, where an hydraulic motor driven earth compacting machine is attached as an auxiliary implement to the boom arm of an excavator or backhoe tractor, or to the lift arms of a front loader tractor or skid steer, such implement may not be conveniently rotated about its longitudinal axis.

Circumstances commonly arise where it is desireable to rotate such an earth compacting implement, so attached to a boom arm or lift arms, about its longitudinal axis. For example, where the ground surface to be compacted laterally slopes with respect to the position of the excavator, loader tractor or skid steer, rotation of the earth compacting implement about a longitudinal axis is desirable. In absence of a capability of rotating the compactor implement about its longitudinal axis, such laterally sloped ground surfaces may be compacted only by repositioning the excavator, loader tractor or skid steer, as the case may be, so that manipulation of bucket rams may orient the compaction plate of the compactor with the slope of the ground to be compacted. Such repositioning of the excavator, loader tractor, or skid steer is undesirable because repositioning wastes valuable time, and maneuvering room allowing machinery repositioning is not always available.

The instant inventive earth compacting machine solves the above noted drawbacks and deficiencies by providing an hydraulic motor driven earth compacting machine attachable as an auxiliary implement to the boom arm of an excavator or backhoe tractor, or to the lift arms of a front loader tractor or skid steer tractor, such compactor having means for selective rotating of its compactor plate about a longitudinal axis.

BRIEF SUMMARY OF THE INVENTION

The instant inventive earth compacting machine preferably comprises a rectangular earth compacting plate having a vibration inducing mechanism fixedly attached to its upper surface. Preferably, the vibration inducing mechanism comprises a pair of off balanced in line gears which are counter-rotated by an hydraulic motor. Such counter-rotating gears are preferably synchronized to cancel lateral vibratory motion and to enhance vertical vibratory motion.

According to a preferred embodiment of the present invention, the compaction plate/vibrator assembly is pivotally mounted upon an attachment plate so that the compaction plate extends forwardly from the attachment plate, and so the compaction plate may move pivotally about a longitudinal axis extending forwardly from the attachment plate. Preferably, the rearwardly facing surface of the attachment plate has couplings which are adapted for fixed attachment to the lift arms of a skid steer loader or a front loader tractor, or which are adapted for fixed attachment to the boom arm of an excavator or backhoe tractor.

Pivoting means interconnecting the attachment plate and the compaction plate preferably comprises a pair of brackets, four shock absorbing mounts, a pair of support arms, a swivel plate, a pair of "ears", and a two way hydraulic ram. Preferably, the pair of brackets are configured as a pair of vertically extending walls fixedly attached to the upper surface of the compaction plate, such walls extending longitudinally along the length of the compaction plate, and such walls being laterally spaced apart along the width of the compaction plate. The four shock absorbing mounts preferably are solid rubber cylinders having steel attachment plates imbedded in their ends. The rubber shock absorbing mounts are preferably respectively fixed attached to the forward and rearward ends of the brackets, and oriented so that they extend inwardly. The pair of support arms preferably are fixedly attached to and span between the inwardly facing surfaces of the shock absorbing mounts, each support arm extending longitudinally between a pair of shock absorbing mounts. The rearward end of each support arm preferably extends rearwardly from the rear most shock absorbing mounts, the rearward surfaces of the support arm providing surfaces for fixed attachment of a rectangular swivel plate, which plate spans between and supports the support arms. Preferably, the swivel plate has a swivel pin receiving aperture therethrough, the swivel pin receiving aperture being pivotally mounted over a swivel pin which is fixedly mounted upon and extends forwardly from the forwardly facing surface of the attachment plate. The ears are preferably fixedly attached to and extend upwardly from the upper edges of the attachment plate and the swivel plate. Preferably, the upper end of each ear has a bolt receiving aperture therethrough. The hydraulic ram preferably spans between and interconnects the upper ends of the ears.

Upon actuation of the hydraulic ram, the ears may be selectively driven apart or pulled together, selectively pivoting the compaction plate about a longitudinal axis extending forwardly from the swivel pin. Such selective rotation of the compaction plate allows ground surfaces which slope laterally with respect to the orientation of, for example, a skid steer loader to which the earth compacting machine is attached, to be efficiently compacted without repositioning the skid steer loader.

Preferably, the forward edge of the compaction plate is straight and extends forwardly from the forward ends of the brackets and support arms. Upon raising the lift arms of, for example, a skid steer to which the earth compacting machine is attached, and upon extending the bucket rams of such skid steer loader, the forward edge of the compaction plate drops downward, orienting the compaction plate vertically with respect to the ground. With the compaction plate so oriented, it may be utilized as a back dragging dirt grader. Pivoting motion, as described above, allows the compaction plate so oriented to selectively move earth rightwardly or leftwardly in a fashion similar to the action of the blade of a common road grader. Preferably, the compaction plate has an inset forward end for enhancing its earth moving capabilities when vertically oriented.

Preferably, a hydraulic selector valve box is fixedly attached to the forwardly facing surface of the attachment plate, and positioned so that it will not interfere with pivotal motion of the swivel plate. Hydraulic pressure input and output lines from the hydraulic system of, for example, a skid steer loader to which the compactor is attached, supplies hydraulic pressure to hydraulic lines extending from the selector box the hydraulic ram, and to the hydraulic motor driven vibrator.

Accordingly, it is an object of the present invention to provide an earth compacting machine which is attachable as an auxiliary implement to the boom arm of an excavator or backhoe tractor or to the lift arms of a front loader tractor or skid steer loader.

It is a further object of the present invention to provide such a compactor which is capable of rotating its compaction plate pivotally about a longitudinal axis for compaction of lateral slopes.

It is a further object of the present invention to provide such a compactor which, through pivotal motion of its compacting plate, may, upon vertical orientation of the compacting plate, function as a back dragging dirt grader.

Other and further objects, benefits, and advantages of the present invention will become known to those skilled in the art upon review of the Detailed Description which follows and upon review of the appended drawings.

DETAILED DESCRIPTION OF THE PREFERRED EMBODIMENT

Figure 1:
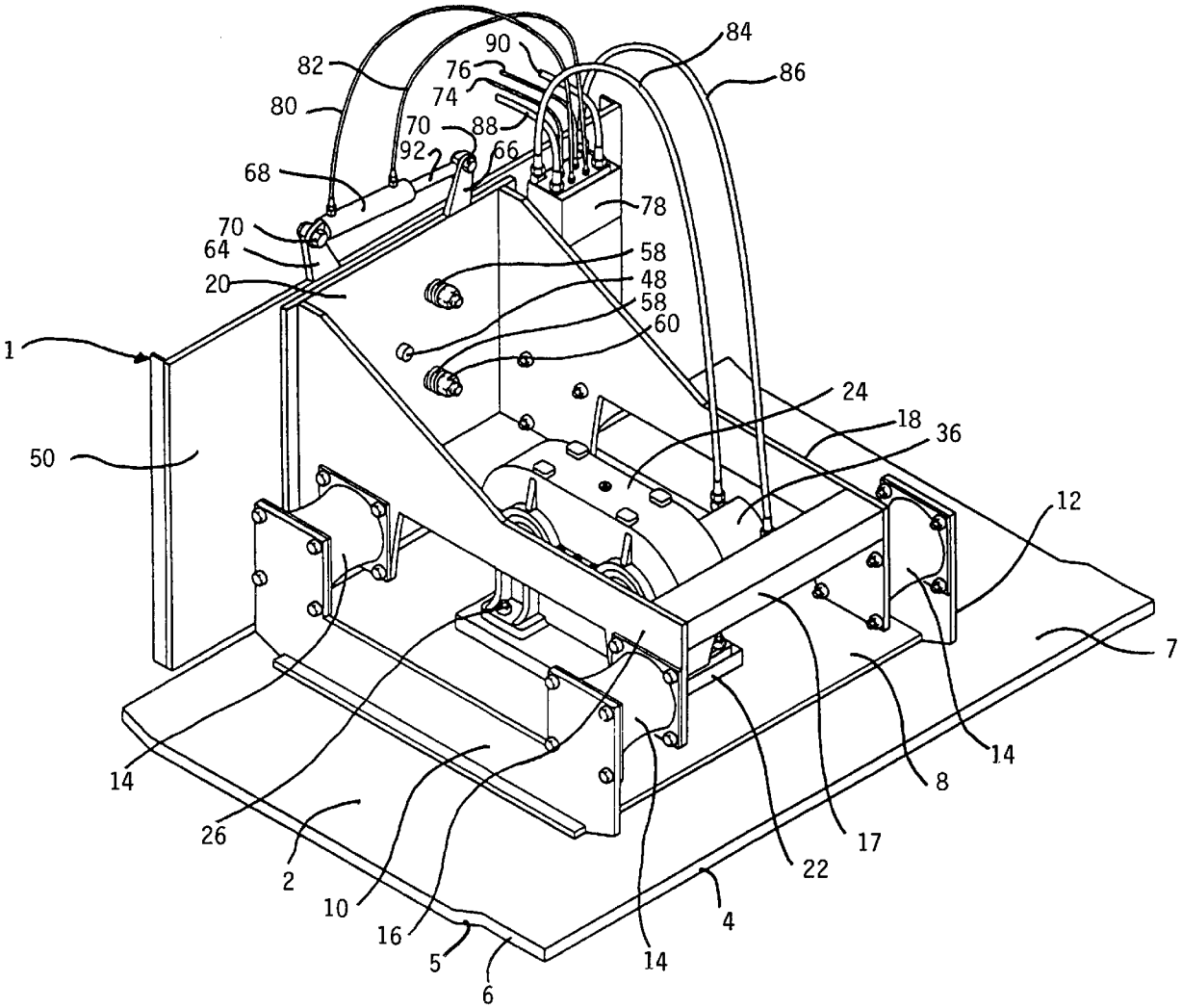
FIG. 1 is an isometric view of the present inventive earth compacting machine.
Figure 3:
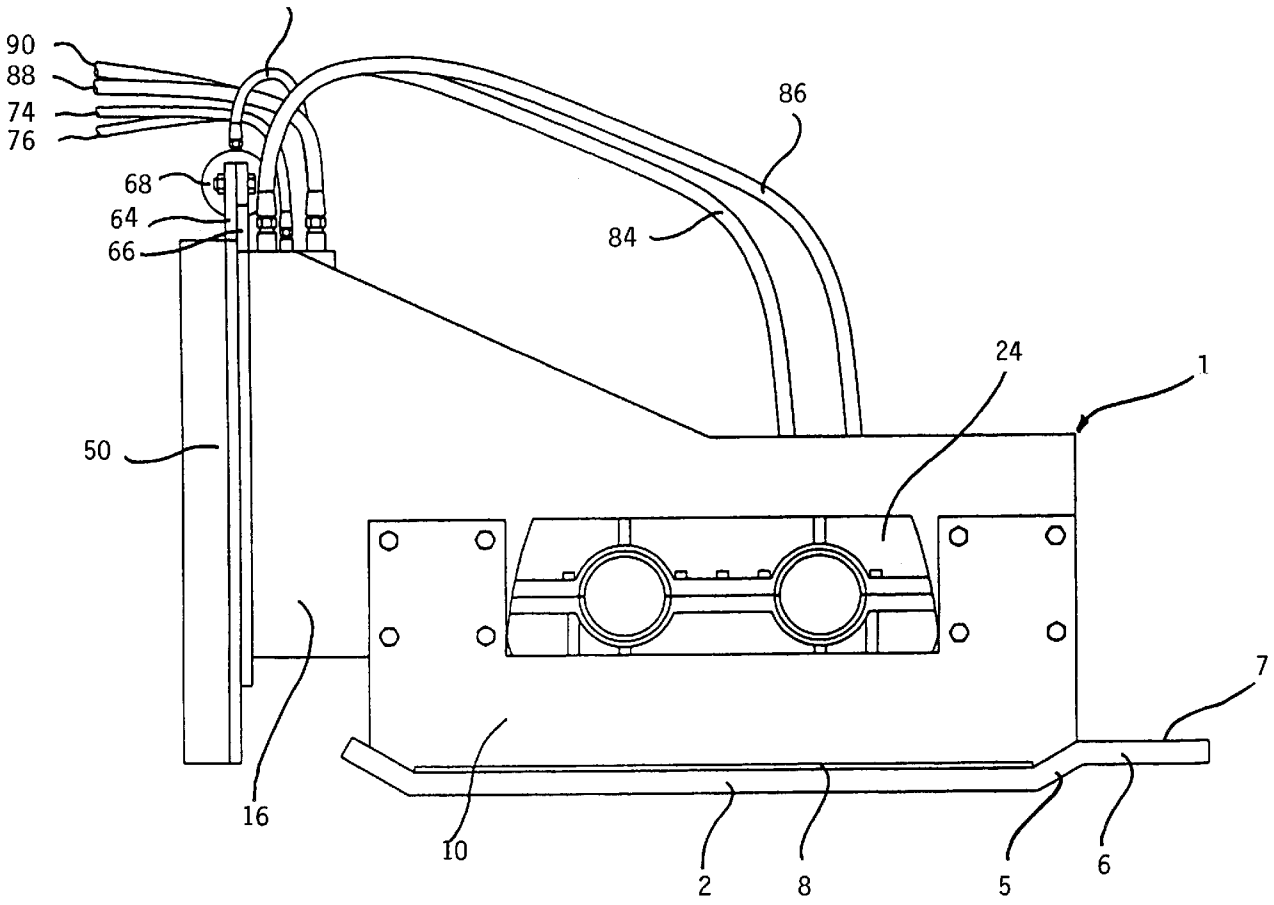
FIG. 3 is a side view of the present inventive earth compacting machine.

Referring now to the drawings, and in particular to FIG. 1, the present inventive earth compacting machine is referred to generally by Drawing Element 1. A rectangular earth compacting plate 2 has a straight forward edge 4. Referring to FIG. 3, the forward end of the compaction plate 2 has an inset section 6 which allows the compaction plate 2, upon vertical orientation with respect to the ground, to be utilized as a back dragging, dirt grading blade; the inset Section 6 comprising an upwardly chamfered or beveled Section 5 and a back dragging dirt grading blade Section 7, such blade Section 7 extending forwardly from the chamfered Section 5.

Referring again to FIG. 1, a substantially square plate 8 is welded to the upper surface of the earth compacting plate 2. A vertically extending right shock mount bracket 10 is welded to the right end of the plate 8, and a vertically extending left shock mount bracket 12 is welded to the left end of the plate 8. Rubber shock mounts 14, each having attachment plates molded as an integral part thereof, are bolted to the inwardly facing surfaces of the right shock mount bracket 10 and the left shock mount bracket 12. Right and left support arms 16 and 18 are similarly bolted to the inwardly facing surfaces of the rubber shock mounts 14. The left and right support arms 18 and 16 preferably extend rearwardly from the rearmost shock mounts 14 providing vertical attachment surfaces for welded attachment of a swivel plate 20, which plate spans between the left and right support arms 14 and 16. A brace 17 spans between and reinforces the forward ends of the left and right support arms 18 and 16.

Figure 4:
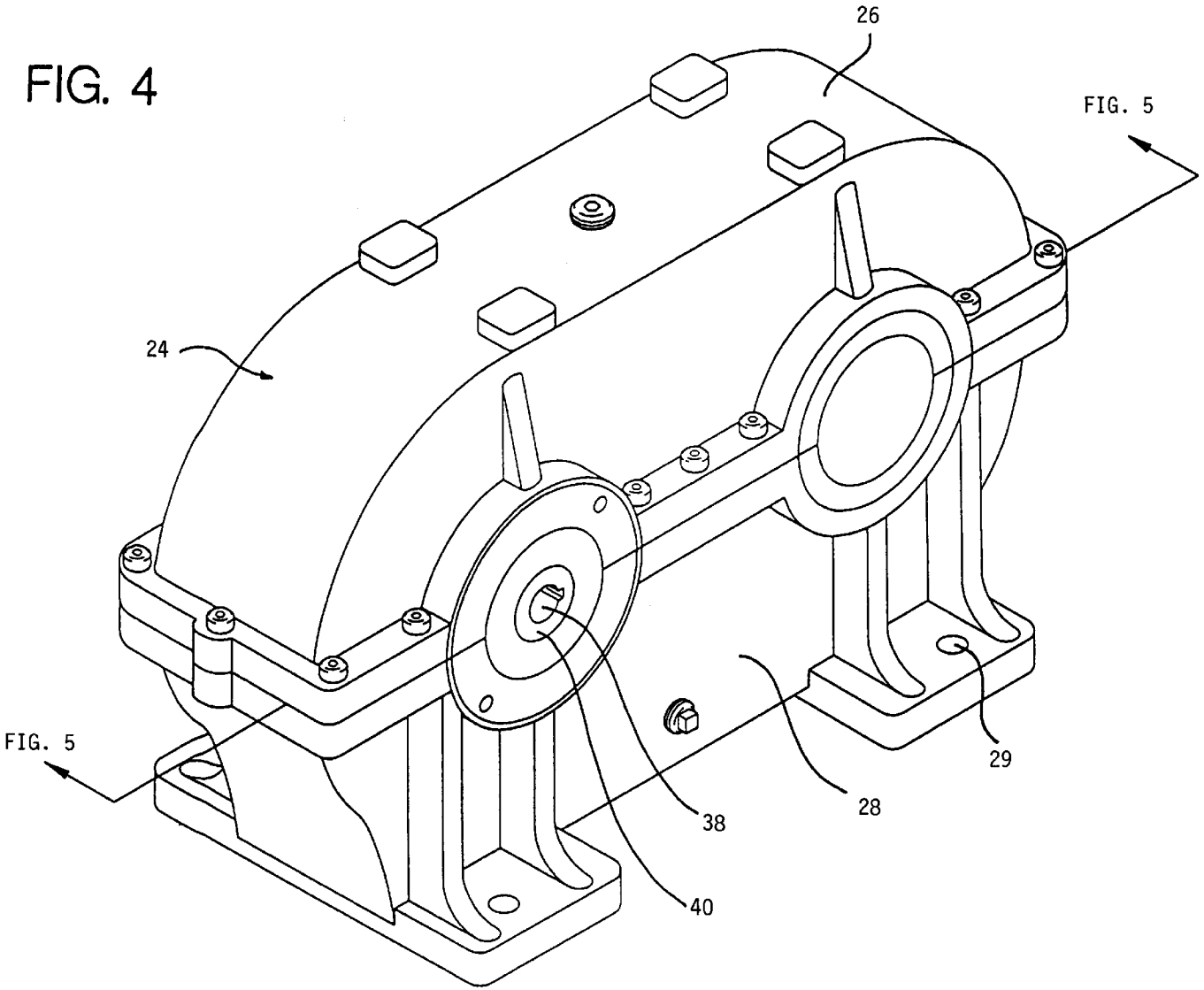
FIG. 4 is a magnified detailed view of the vibrating mechanism of the present inventive earth compacting machine.
Figure 5:
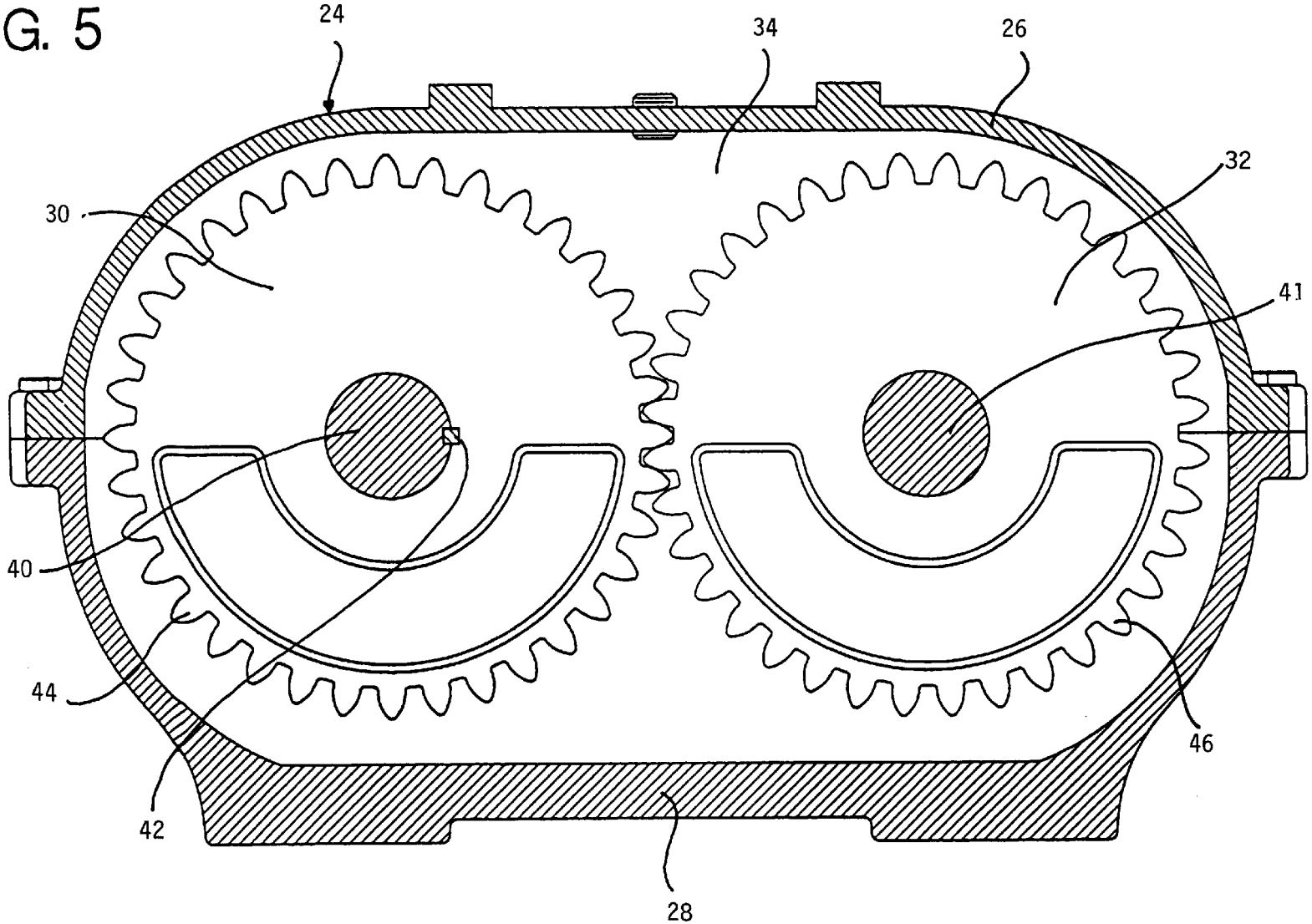
FIG. 5 is a sectional view of the mechanism depicted in FIG. 4.

A plate 22 is preferably welded to plate 8, the upper surface of the plate 22 providing for fixed attachment of a vibrating mechanism 24, the vibrating mechanism being fixedly attached to plate 22 by means of threaded bolts and nuts 26. Referring to FIG. 4, the vibrating mechanism 24 preferably has a cast steel housing consisting of an oblongated cap 26 which fits over and occlusively seals an oblongated bowl 28. Referring to FIG. 5, off balanced gears 30 and 32 are preferably rotatably mounted within the interior space 34 of the vibrating mechanism 24, such gears rotating respectively about axles 40 and 41. The teeth 44 and 46 of gears 30 and 32 allow them to rotate in a synchronized relationship providing vertical vibratory motion while cancelling lateral vibratory motion. Referring simultaneously to FIGS. 1 and 4, the drive shaft (not shown) of an hydraulic motor 36 extends into a drive shaft receiving aperture 38. Referring simultaneously to FIGS. 1, 4 and 5, rotational torque applied by the hydraulic motor 36 to its drive shaft turns the axle 40, transmitting rotational torque to the gear 30 via a key 42. The teeth 44 of gear 30 engage teeth 46 of gear 32, counter-rotating gear 32 with respect to gear 30. While utilization of a vibrating mechanism such as is depicted in FIGS. 4 and 5 is preferable, numerous other types of vibrating mechanisms, such as single wheel vibrators, may suitably be utilized.

Figure 2:
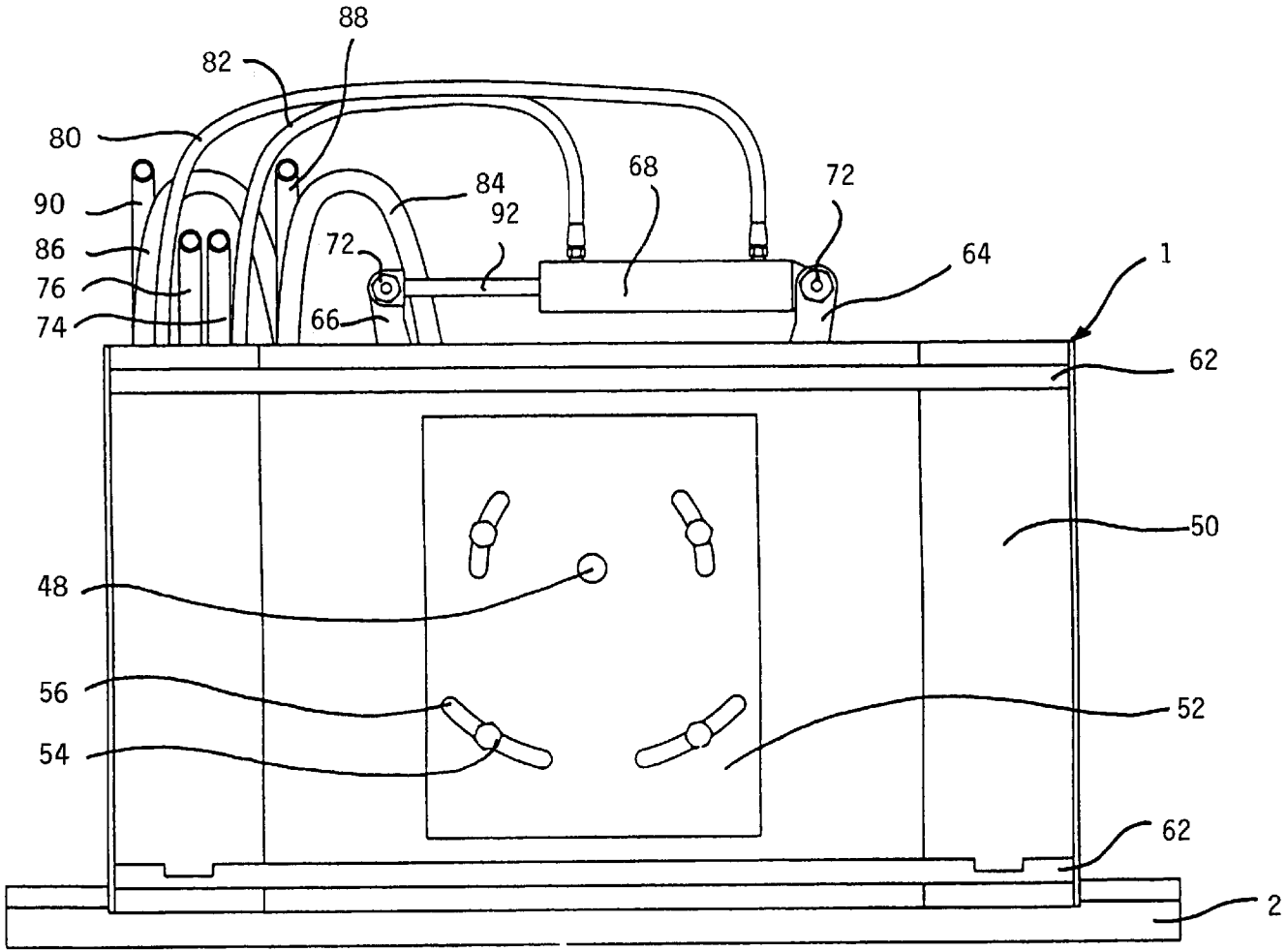
FIG. 2 is a view from the rear of the present inventive earth compacting machine.

Referring again to FIG. 1, the swivel plate 20 has a swivel pin receiving aperture through which a swivel pin 48 extends, the swivel pin 48 being fixedly attached to and extending forwardly from an attachment plate 50. Referring simultaneously to FIGS. 1 and 2, a reinforcement plate 52 is welded to the rearwardly facing surface of the attachment plate 50. Bolts 54 extend through curved apertures 56, such apertures extending through the reinforcement plate 52 and through the attachment plate 50. The bolts 54 further extend through circular apertures within the swivel plate 20 to protrude forwardly from the forward surface of the swivel plate 20. Springs 58 are mounted over the bolts 54 and nuts 60 are threadedly mounted over the bolts 54. The springs 58 exert outwardly biased pressure upon the rearwardly facing surfaces of the nuts 60 and upon the forwardly facing surface of the swivel plate 20, pressing the rearwardly facing surface of the swivel plate 20 against the forwardly facing surface of the attachment plate 50. Upon pivoting motion of the swivel plate 20 about the swivel pin 48, the bolts 54 slidably move along the curved slots 56. The combination of the bolts 54, the springs 58, the swivel pin 48, and the slots 56 provide for firm shock absorbing support of the compaction plate 2 while allowing pivotal motion of the compaction plate 2 about a longitudinal axis extending forwardly from the swivel pin 48.

Referring to FIG. 2, showing the rearwardly facing surface of the attachment plate 50, quick release/quick attachment brackets 62 are fixedly welded to the upper and lower ends of the attachment plate 50, such brackets 62 functioning to engage hydraulically extendable attachment lugs of, for example, an implement attachment bracket of a skid steer loader's boom arms. Other suitable attaching means such as device joints may alternately be fixedly welded onto the rearward surface of the attachment plate 50 in place of brackets 62. Also, alternately, through utilization of closely spaced and centrally located device joints, the attachment plate 50 may be suitably adapted for attachment to the boom arm of an excavator or backhoe tractor.

Referring again to FIG. 1, a first ear 64 extends upwardly from the upper edge of the attachment plate 50, and a second ear 66 extends upwardly from the upper edge of the swivel plate 20, each ear 64 and 66 having a bolt receiving aperture therethrough. A two way hydraulic ram 68 is preferably pivotally mounted thereon by means of bolts 70 and, referring to FIG. 2, nuts 72, the ram 68 spanning between and interconnecting gears 64 and 66. Referring to FIG. 1, extension and retraction of the ram 68 alternately spreads apart and pulls together the ears 64 and 66, rotating the swivel plate 20 about swivel pin 48 and, referring to FIG. 2, slidably moving the bolts 54 within slots 56.

Referring again to FIG. 1, valve control cables 74 and 76 provide remote control of hydraulic selector valves (not shown) housed within a valve box 78 which is mounted upon the forwardly facing surface of the attachment plate 50. Within the valve box 78, a three position selector valve controls flow of hydraulic fluid to ram hydraulic lines 80 and 82, and a two position selector valve controls hydraulic flow to motor hydraulic lines 84 and 86. Hydraulic fluid pressure is provided to the selector valves by an auxiliary hydraulic line 88, hydraulic fluid being returned through an hydraulic return line 90. Hydraulic lines 88 and 90 preferably are attached to an auxiliary hydraulic system of, for example, a skid steer loader (not shown) to which the earth compacting machine 1 is attached.

In operation of the earth compacting machine 1, an operator may desire to compact a rightwardly sloping ground surface. In order to do so, cables 74 and 76 are actuated to transmit a flow of hydraulic fluid to hydraulic line 82 causing the shaft 92 of hydraulic ram 68 to retract, pulling ears 66 and 64 together, and rotating the compaction plate 2 so that its right edge drops and its left edge rises. Through alternate flow of hydraulic fluid within lines 80 and 82, the right edge of the compaction plate 2 may be alternately raised and the left edge of the compaction plate 2 lowered.

In order to utilize the earth compacting machine 1 as a back dragging dirt grader, the bucket rams of, for example, a skid steer loader to which the compacting machine 1 is attached, are actuated, pivoting the machine 1 about its lateral axis and causing the compaction plate 2 to be vertically oriented. With the compaction plate 2 so positioned, the rearwardly facing surface of the compaction plate 2 may be utilized to drag dirt rearwardly. Through alternate extension and retraction of the hydraulic ram 68, the compaction plate 2 may be pivoted about its new vertical axis, allowing the compaction plate 2 to function in a manner similar to that of the blade of a road grader, moving dirt either leftwardly or rightwardly.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An earth compacting machine for attachment to the lift arms of a front loader tractor or skid steer loader, the lift arms having forward implement attachment ends, the lift arms having bucket rams providing pivotal motion of implements attached thereto, the earth compacting machine comprising:

(a) an earth compacting plate having an upper surface, a substantially planar lower surface, and a forward end, the forward end of the compacting plate having an upwardly chamfered section, the upwardly chamfered section having an upper end;

(b) An attachment plate fixedly attached to and extending upwardly from the earth compacting plate, the attachment plate being adapted for attachment to the forward implement attachment ends of such lift arms of such front loader tractor or skid steer loader; and (c) vibrating means fixedly attached to the upper surface of the earth compacting plate;

the earth compacting plate further comprising a dirt grading blade section fixedly attached to or homogeneously fused with the upper end of the chamfered section of the earth compacting plate, the dirt grading blade section being positioned so that, upon attachment of the attachment plate to the forward implement attachment ends of such front loader tractor or skid steer loader, the dirt grading blade section is vertically positionable for dirt grading through actuation of the bucket rams.

* * * * *